US006544411B2

(12) United States Patent
Varadaraj

(10) Patent No.: US 6,544,411 B2
(45) Date of Patent: Apr. 8, 2003

(54) VISCOSITY REDUCTION OF OILS BY SONIC TREATMENT

(75) Inventor: Ramesh Varadaraj, Flemington, NJ (US)

(73) Assignee: ExxonMobile Research and Engineering Co., Annandale, NJ (US)

( * ) Notice: Subject to any disclaimer, the term of this patent is extended or adjusted under 35 U.S.C. 154(b) by 88 days.

(21) Appl. No.: 09/803,734

(22) Filed: Mar. 9, 2001

(65) Prior Publication Data

US 2002/0125174 A1 Sep. 12, 2002

(51) Int. Cl.[7] ..... C10G 17/00; C10G 17/06

(52) U.S. Cl. ..... 208/265; 208/266; 208/267; 208/280; 208/281; 208/282; 204/157.15

(58) Field of Search ..... 208/265, 266, 208/267, 280, 281, 282; 204/157.15

(56) References Cited

U.S. PATENT DOCUMENTS 5,824,214 A * 10/1998 Paul et al. ..... 208/107

* cited by examiner

*Primary Examiner*—Walter D. Griffin
*Assistant Examiner*—Tam M. Nguyen
(74) *Attorney, Agent, or Firm*—Linda M. Scuorzo; Ramesh Varadaraj

(57) ABSTRACT

The invention describes a method for decreasing the viscosity of crude oils and residuum utilizing a combination of acid and sonic treatment.

10 Claims, 3 Drawing Sheets

VISCOSITY REDUCTION OF OILS BY SONIC TREATMENT

FIELD OF THE INVENTION

The present invention relates to a method for reducing the viscosity of crude oils and crude oil residuum by treatment of crude oil or crude oil residuum with sound waves. The product from the sonic treatment process affords oil with a substantially lower viscosity than the starting oil.

BACKGROUND OF THE INVENTION

Heavy oils are generally referred to those oils with high viscosity or API gravity less than about 23. The origin of high viscosity has been attributed to high asphaltene and naphthenic acid content of the oils. Viscosity reduction of heavy oils is important in production, transportation and refining operations of crude oil. Transporters and refiners of heavy crude oil have developed different techniques to reduce the viscosity of heavy crude oils to improve its pumpability. Commonly practiced methods include diluting the crude oil with gas condensate and emulsification with caustic and water. Thermally treating crude oil to reduce its viscosity is also well known in the art. Thermal techniques for visbreaking and hydro-visbreaking (visbreaking with hydrogen addition) are practiced commercially. The prior art in the area of thermal treatment or additive enhanced visbreaking of hydrocarbons teach methods for improving the quality, or reducing the viscosity, of crude oils, crude oil distillates or residuum by several different methods. For example, several references teach the use of additives such as the use of free radical initiators (U.S. Pat. No. 4,298,455), thiol compounds and aromatic hydrogen donors (EP 175511), free radical acceptors (U.S. Pat. No. 3,707,459), and hydrogen donor solvent (U.S. Pat. No. 4,592,830). Other art teaches the use of specific catalysts such as low acidity zeolite catalysts (U.S. Pat. No. 4,411,770) and molybdenum catalysts, ammonium sulfide and water (U.S. Pat. No. 4,659,453). Other references teach upgrading of petroleum resids and heavy oils (Murray R. Gray, Marcel Dekker, 1994, pp. 239–243) and thermal decomposition of naphthenic acids (U.S. Pat. No. 5,820,750).

Generally, the process of treatment of a fluid with sound waves is termed sonication or sonic treatment. The main drawback of sonic treatment for viscosity reduction of heavy oils is that the effect is reversible. The viscosity of the sonic treated oil recovers back to the original viscosity of the oil and in some crude oils viscosity of the product after sonication is higher than the starting oil. There is therefore a need to irreversibly reduce the viscosity of heavy oils by sonication so that sonication can be effectively used as a method for viscosity reduction.

SUMMARY OF THE INVENTION

It is this aspect of irreversible viscosity reduction by sonic treatment that this application addresses. Provided is a method of irreversibly reducing the viscosity of oil by an acid enhanced sonic treatment process. The product from the acid enhanced sonic treatment process has a substantially lower viscosity than the untreated oil.

An embodiment of the invention is directed to a method for decreasing the viscosity of crude oils or crude oil residuum comprising the steps of:

contacting the crude oil with an effective amount of an acid comprising organic acid, mineral acid or mixtures thereof, sonicating said acid treated crude oil at a temperature and for a time sufficient to decrease the viscosity of said crude oil or residuum.

Another embodiment of the invention is directed to a crude oil or crude residuum having decreased viscosity prepared by contacting the crude oil or residuum with an effective amount of an acid comprising organic acid, mineral acid or mixtures thereof, sonicating said acid treated crude oil or residuum at a temperature and for a time sufficient to decrease the viscosity of said crude oil or residuum.

DETAILED DESCRIPTION OF THE INVENTION

Figure 1:
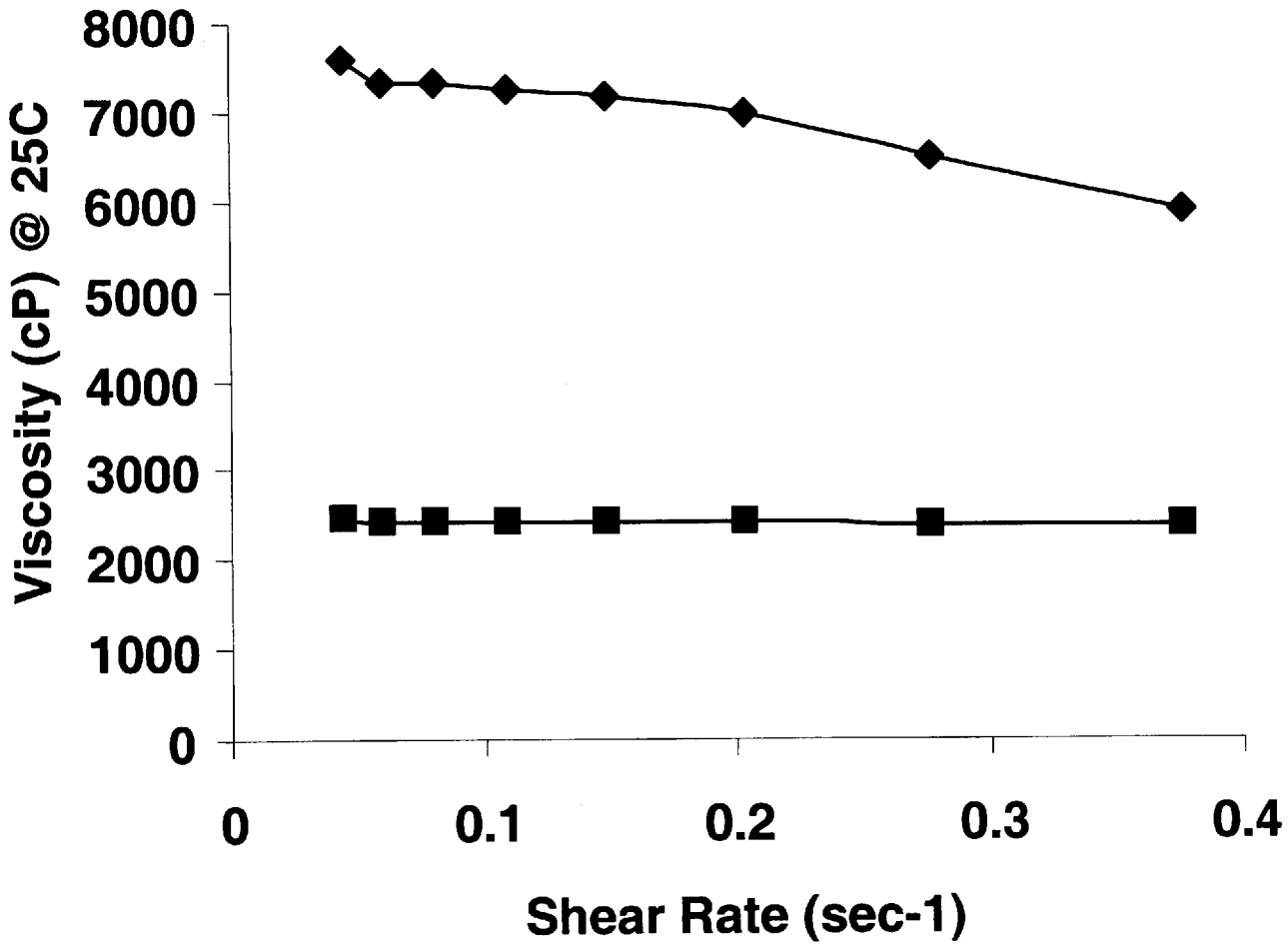
FIG. 1 is a plot of viscosity versus shear rate plots for the untreated and sonic treated Kome crude oils at 25° C. The X axis is shear rate ($sec^{-1}$) and the Y axis is viscosity (cP). The line with diamonds is the untreated crude oil. The line with squares is crude oil treated with acid and sonicated.

According to an embodiment of the invention, there is provided a method for viscosity reduction of crude oils and crude oil residuum. An acid is added to the crude or residuum followed by sonic treatment at temperatures in the range of about 25 to about 50° C. for about 30 seconds to 1 hour. Typically, the amount of acid added will be about 10 to about 10,000 ppm, preferably about 20 to 100 ppm, based on the amount of crude oil or crude oil residuum.

The types of acids, which can be utilized include mineral acids such as sulfuric acid, hydrochloric acid and perchloric acid. Organic acids like acetic, para-toluene sulfonic, alkyl toluene sulfonic acids, mono di- and trialkyl phosphoric acids, organic mono or di carboxylic acids, formic, $C_3$ to $C_{16}$ organic carboxylic acids, succinic acid, and low molecular weight petroleum naphthenic acid are also effective in this invention. Crude oil high in naphthenic acid content (TAN) can be used as the source of petroleum naphthenic acids. Mixtures of mineral acids, mixtures of organic acids or combinations of mineral and organic acids may be used to produce the same effect. The preferred mineral acid is sulfuric or hydrochloric acid. The preferred organic acid is acetic acid. Nitric acid should be avoided since it could potentially form an explosive mixture. As used herein, crude oil residuum is defined as residual crude oil obtained from atmospheric or vacuum distillation.

Acid addition to crude oils to achieve viscosity reduction is unexpected. Such an addition of acid to acidic crude oil is counter intuitive since refiners are continuously looking for methods which reduce the amount of acid in crude oils and residuum.

Sonication is the act of subjecting a fluid to sound (acoustic) waves. A typical commercial sonicator is in the shape of a tapered rod or horn. While a horn type sonicator is preferred other shapes of sonicators can also be used. The velocity of sound in liquids is typically about 1500 meters/sec. Ultrasound spans the frequency of about 15 kHz to 10 MHz with associated wavelengths of about 10 to 0.02 cm. Frequencies of about 15 kHz to about 20 MHz can be used. The output energy at a given frequency is expressed as sonication energy in units of watts/cm$^2$. The sonication is typically accomplished at energies in the range of 200 watts/cm$^2$ to 800 watts/cm$^2$. The time of sonication can vary in the range of 0.5 minutes to 6 hours. Sonic treatment can be continuous or in pulse mode. At the time of starting the sonic treatment the crude oil can be at temperatures in the range of 15 to 70° C. and atmospheric pressure. It is preferred mix the crude oil during treatment at low shear rates. The preferred shear rates are between 50 to 200 rpm.

The sonic treatment process can be conducted in batch or flow-through process modes. The flow-through process mode is preferred in pipeline transportation applications. In a flow-through mode, the crude oil is pumped through a pipe to which are attached the sonicator horn tips in a radial manner. The rate of crude oil flow is optimized for maximum desirable exposure of the crude oil to the cavitation field. If desired, a recycle loop can be introduced for repeated sonic treatment. The batch process mode is preferred in upgrading applications. It is preferred to introduce several sonicator horn tips at various heights of the reactor vessel. A stirred reactor with low shear stirring is preferred. The sonic treatment process can be conducted in an inert environment. The inert environment can be achieved by including an inert gas purge during the sonication step of the sonic treatment process for decreasing the viscosity of crude oils and residuum. One of ordinary skill in the art will recognize gases like argon and nitrogen are some examples of inert gases.

EXAMPLES

The following examples are included herein for illustrative purposes and are not meant to be limiting.

In a typical experiment 10 g of crude oil was placed in a 4 oz. open-mouthed glass jar. A Vibra cell model VC 600 sonicator with a sonicator horn assembly was used. The sonicator horn was immersed into the crude oil and powered for times between 30 sec to 10 minutes as desired. A 400 watt/cm$^2$ energy was introduced during sonication. During treatment, the crude oil was observed to bubble with increase in temperature from ambient to about 70° C. No attempt was made to control the temperature. The open vessel configuration allowed no confining pressure to be applied to the vessel. In situations where gentle mixing was desired, a magnetic stir bar rotating at 50 to 200 rpm was used is to mix the crude oil.

To 10 g of Kome crude oil was added dilute sulfuric acid so that the final concentration of acid was 100 ppm. The viscosity of the starting oil before sonication was recorded. The acid treated crude oil was sonicated for 2 minutes. Immediately following sonication the viscosity of the product was recorded. Results are shown in FIG. 1. About 4-fold reduction in viscosity is observed in the acid treated sonicated sample. The viscosity of the treated sample was recorded every hour for 6 hours and then every week for 2 months. No change in viscosity was noted in the acid treated sonicated sample.

For comparative purposes Kome crude oil, which was not pretreated with sulfuric acid, was sonicated and viscosity measurements conducted as described above. The non-acid treated sonicated sample showed a 2-fold decrease in viscosity immediately following sonication. The viscosity recovered to its original value within 1 hour.

The influence of shear rate on viscosity reduction for the untreated and treated oils is evident from the results in FIG. 1. Untreated crude oil exhibits shear thinning or non-Newtonian behavior although the magnitude is small. The sonicated crude oil is Newtonian and does not exhibit shear thinning. Its viscosity is independent of shear.

Figure 2:
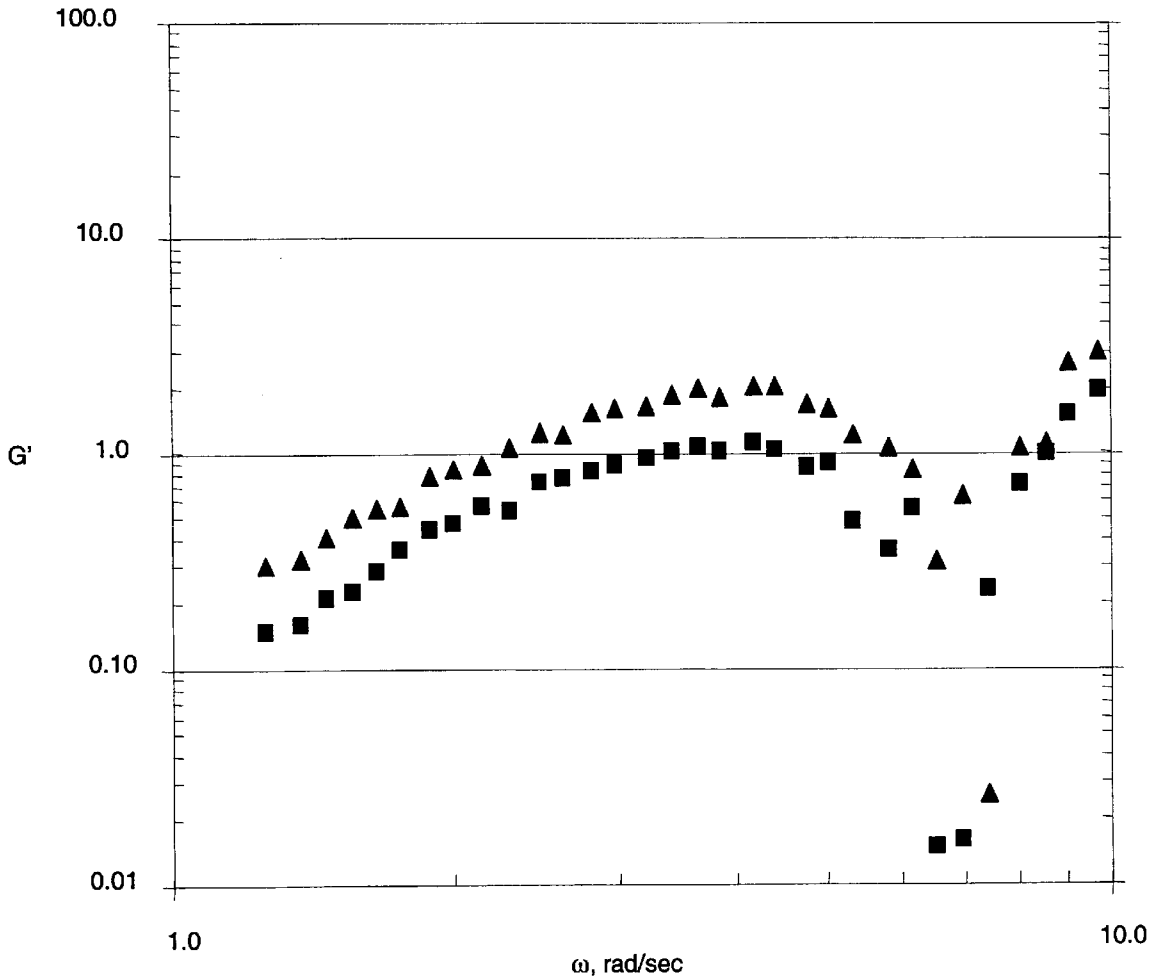
FIG. 2 is a plot of the elastic modulus (G') along the Y axis as a function of sweep frequency in radians/second along the X axis for a fixed sinusoidal oscillation at 25° C. The line with triangles is the untreated crude oil. The line with squares is crude oil treated with acid and sonicated.
Figure 3:
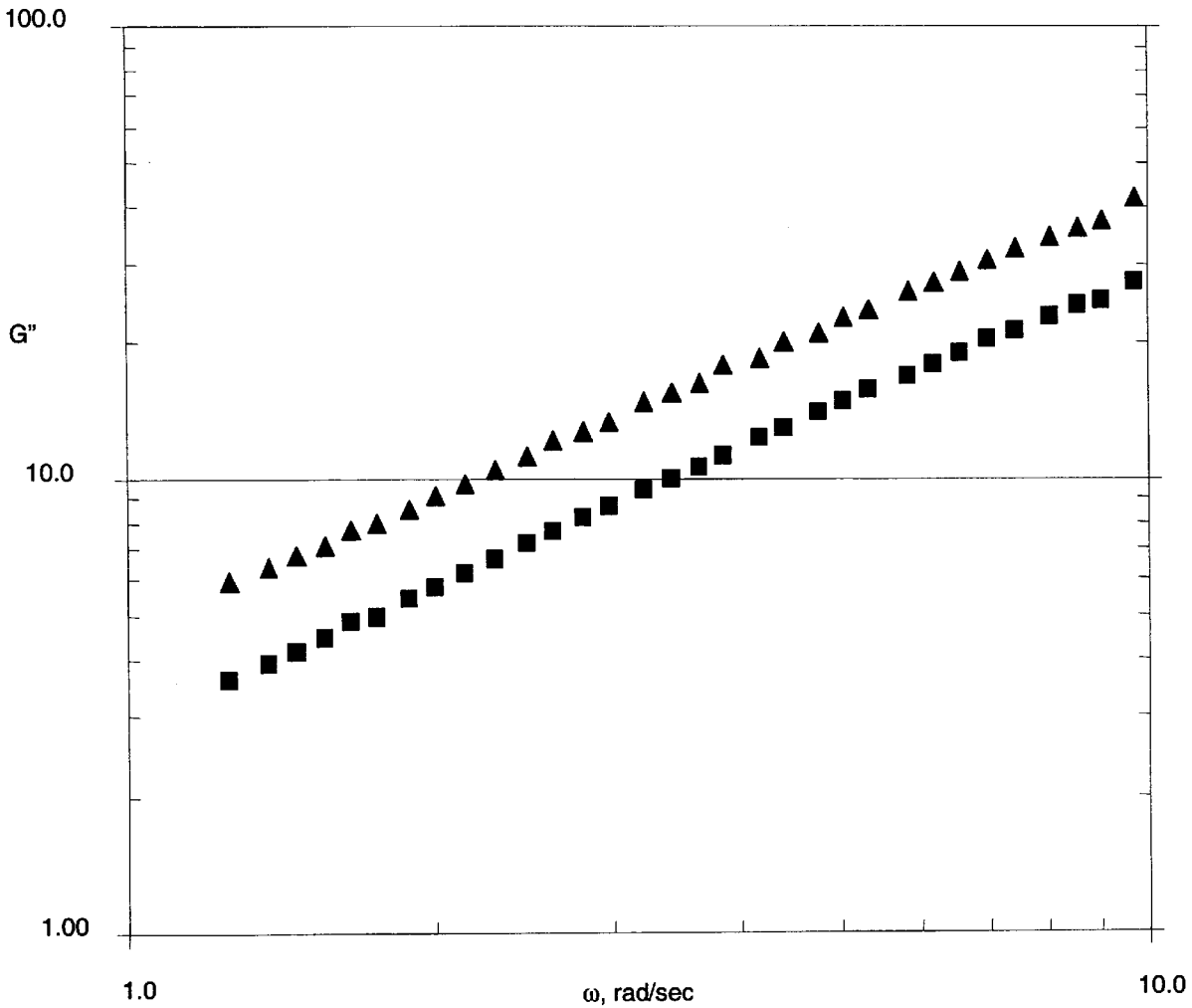
FIG. 3 is a plot of the viscous modulus (G") as a function o sweep frequency in radians/second along the X axis for a fixed sinusoidal oscillation at 25° C. The line with triangles is the untreated crude oil. The line with squares is crude oil treated with acid and sonicated.

FIG. 2 is a plot of the elastic modulus (G') and viscous modulus (G") as a function of sweep frequency for a fixed sinusoidal oscillation. The elastic modulus (G') and viscous modulus (G") were determined using a Haake viscometer in the oscillatory mode of operation. Data for untreated Kome crude oil and sonic treated crude oil are shown. A decrease in the absolute value of G' and G" are observed upon sonic treatment. Further, a change in the value of the intercept of the G'versus frequency and G" versus frequency plots are also observed. These results reveal that the product from the sonic treatment process has unique Theological properties.

What is claimed is:

1. A process for decreasing the viscosity of crude oils and residuum comprising the steps of:

(a) contacting the crude oil or crude oil residuum with an effective amount of an acid selected from the group consisting of sulfuric acid, hydrochloric acid, perchloric acid, acetic acid, para-toluene sulfonic acid, alkyl toluene sulfonic acids, mono di and trialkyl phosphoric acids, $C_3$ to $C_{16}$ organic carboxylic acids, succinic acid , petroleum naphthenic acid and mixtures thereof, (b) sonicating said crude oil or crude oil residuum and said acid at a temperature and for a time sufficient to decrease the viscosity of said crude oil or residuum.

2. The process of claim 1 wherein said acid is sulfuric acid.

3. The process of claim 1 wherein said acid is petroleum naphthenic acid.

4. The process of claim 1 wherein said step (b) is conducted at temperatures of about 20 to about 70° C.

5. The process of claim 1 wherein said step (b) is conducted for times of about 0.15 to 6 hours.

6. The process of claim 1 wherein the amount of said acid utilized is about 10 to about 10,000 ppm based on the amount of crude oil or crude oil residuum.

7. The process of claim 1 wherein said sonication is conducted at frequencies of about 15 kHz to about 10 MHz.

8. The process of claim 1 wherein said sonication is conducted at energy of about 25 to about 800 watts/cm$^2$.

9. The process of claim 1 wherein said process step (b) further includes an inert gas purge.

10. The process of claim 1 wherein said process step (b) is conducted in an inert environment.

* * * * *